United States Patent [19]

Ito

[11] 4,235,214

[45] Nov. 25, 1980

[54] SECONDARY AIR GUIDE RING FOR IGNITION PLUG

[75] Inventor: Kiyoshi Ito, Kawasaki, Japan

[73] Assignee: Kabushiki Kaisha IDK, Tokyo, Japan

[21] Appl. No.: 924,434

[22] Filed: Jul. 13, 1978

[30] Foreign Application Priority Data

Mar. 13, 1978 [JP] Japan ..... 53-028482

[51] Int. Cl.[3] ..... F02P 1/00

[52] U.S. Cl. ..... 123/169 V; 313/120

[58] Field of Search ..... 123/169 V; 313/120

[56] References Cited

U.S. PATENT DOCUMENTS

| | | | |
|---|---|---|---|
| 1,424,700 | 8/1922 | Williams | 313/120 |
| 1,917,888 | 7/1933 | Hyde | 313/120 |
| 3,079,453 | 2/1963 | Clark | 123/169 V |

*Primary Examiner*—Ronald B. Cox

*Attorney, Agent, or Firm*—Haseltine, Lake & Waters

[57] ABSTRACT

A secondary air guide ring for an ignition plug, which is mounted on the outer periphery of a male thread of an ignition plug for mounting the same ignition plug in a cylinder head and provides a hermetical seal between the ignition plug and cylinder head. It is provided with an air guide hole for leading air into the cylinder and also with a check valve mechanism serving to prevent counter flow of gas.

3 Claims, 4 Drawing Figures

SECONDARY AIR GUIDE RING FOR IGNITION PLUG

BACKGROUND OF THE INVENTION

This invention relates to a secondary air guide ring for an ignition plug and, more particularly, to one which is mounted on the ignition plug such as to permit effective scavenging of residual gas in an internal combustion engine such as a gasoline engine and also promote complete combustion of the combustion gas.

The residual gas in the cylinder of an internal combustion engine generally reduces the average effective pressure in the cylinder, charging efficiency and so forth and increases the temperature within the cylinder, and thus the temperature and weight of the residual gas has great influence upon the engine performance.

In particular, it has been found that the pressure of the combustion gas within the cylinder locally assumes values lower than the atmospheric pressure, that is, becomes negative pressure, in the intake stroke and power and exhaust strokes.

This phenomenon of reduction of the pressure of the combsution gas is observed in a variety of internal combustion engines such as gasoline engines, diesel engines and rotary engines, and it is thought to stem from the fact that combusted gas consumes oxygen at the time of propagation of flame. Accordingly, various attempts have hitherto been made to reduce the weight and temprature of the residual gas by blowing secondary air into the cylinder. As a result of these attempts, the inventor has developed an ignition plug having a check valve mechanism. In this ignition plug, the center electrode of the positive electrode body is provided with an air guide passage communicating the inside and outside of the cylinder, and a check valve for preventing the counter flow of gas in the cylinder is provided in an intermediate portion of the air guide passage. Since this construction permits the afore-mentioned secondary air introducing method to be realized without substantially changing the main portion of the engine, its utility is expected.

However, since in the afore-mentioned ignition plug the air guide passage and check valve mechanism are assembled in the center electrode of a very small diameter, the manufacture is very difficult compared to the conventional plug, thus leading to high cost, and also the structure has low mechanical strength and short service life.

Further, it has been proved by experiments conducted by the inventor by trial manufacturing the afore-mentioned ignition plug and mounting it on an engine, that the afore-said check valve on-off operates for introducing air in accordance with the engine rotation at the time of low speed operation of idling operation of the engine, in case of high speed operation or under high load the valve no longer on-off operates according to the engine rotation and counter flow of air-fuel mixture into the passage is caused to cause abnormal explosion in the inside, thus causing extreme wear of the ignition plug itself and also causing great noize accompanying the on-off operation of the valve.

This is attributable to the fact that the valve stroke of the check valve is so large that air in excess of the required quantity is introduced into the engine. However, since the afore-mentioned air guide passage must extend through the center electrode in the longitudinal direction thereof in view of the construction of the ignition plug, it has inevitably a length. Therefore, its diameter has to be extremely small. In addition, in case if the check valve itself is very small, the function of introducing secondary air cannot be obtained at all.

From the above grounds, although the method of secondary air introduction by using the afore-mentioned ignition plug has the above advantages, it does not permit expected effects to be obtained and thus has not been used in actual practice up to date.

SUMMARY OF THE INVENTION

An object of the invention is to provide a secondary air guide ring, which permits, when the ignition plug is mounted in the cylinder head of an internal combustion engine, to substantially improve the effective average voltage within the cylinder, charging efficiency and so forth so as to widely reduce fuel consumption while also reducing generation of oxides of nitrogen, etc.

Another object of the invention is to provide a secondary air guide ring, which has sufficient gas-tightness and can effectively introduce external air into the cylinder by following the engine speed with fidelity.

A further object of the invention is to provide a secondary air guide ring, which is simple in construction and small in size and can be readily mounted even on conventional ignition plug, as well as having long service life and being inexpensive in manifacture.

A still further object of the invention is to provide a secondary air guide ring, which can be simply mounted in case of the conventional automotive engines.

DETAILED DESCRIPTION OF THE PREFERRED EMBODIMENTS

Figure 1:
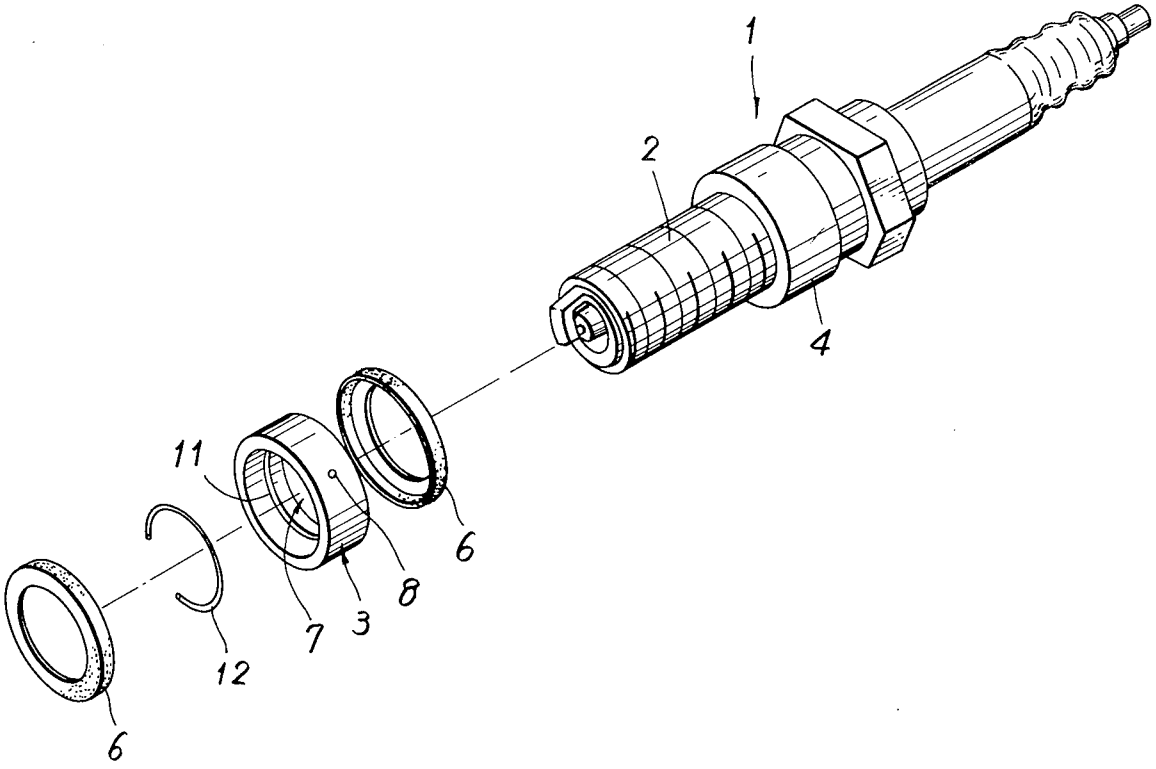
FIG. 1 is a perspective view of a secondary air guide ring according to the invention.
Figure 2:
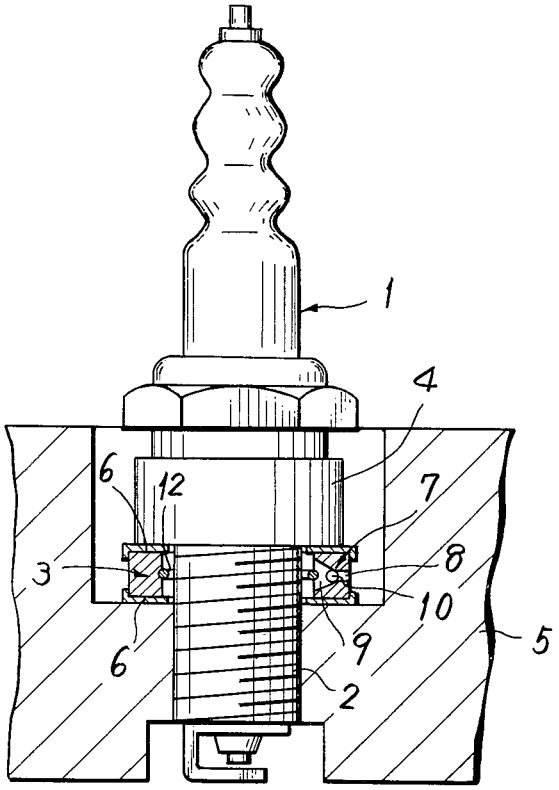
FIG. 2 is an axial sectional view showing the same secondary air guide ring mounted together with the relevant ignition plug on a cylinder head.

Referring to FIGS. 1 and 2, a secondary air guide ring according to the invention comprises a ring body 3 fitted on the outer periphery of a male thread portion 2 of an ignition plug 1 to be mounted in the cylinder head, and copper packings 6 for hermetically sealing a flange portion 4 of an ignition plug 1 and a seat surface of the cylinder head 5 are held in close contact with the respective upper and lower sides of the ring body 3 by means of caulking. The ring body 3 is provided with a check valve mechanism 7.

Figure 3:
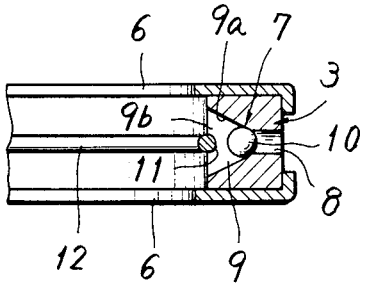
FIG. 3 is an enlarged-scale fragmentary view showing the same secondary air guide ring.

More particularly, the ring body 3 is provided with an air guide hole 8 penetrating its peripheral wall in the radial direction to communicate the cylinder interior and atmosphere. This secondary air guide hole 8 includes or terminates in a valve chamber 9 flaring toward the inside as shown in FIG. 3. A ball 10, which is a valve body, is disposed within the valve chamber 9 such that is can be brought into contact with or separation from a valve seat surface **9*a* for closing or opening the guide hole 8**.

The inner periphery of the ring body 3 is formed with a peripheral groove 11 crossing with the opening **9*b* of the valve chamber 9, and a retainer ring having a spring character formed by bending a piano wire or the like is received in the perhperal groove 11 to prevent detachment of said ball valve body 10 from the opening 9***a b*. These parts constitute a check valve mechanism 7.

The ring body 3 and ball valve body 10 are made of materials of different hardnesses.

In the instant embodiment, the ring body 3 is made of a soft metal as brass, while the ball valve body 10 is made of a hard metal such as steel. In this case, as the ball valve body 10 reciprocates within the valve chamber 9 in accordance with the engine cycle, its spherical surface is repeatedly brought into contact with the valve seat surface 9*a*, thus eventually causing deformation of the seat surface 9*a*. Thus, with the self-correcting action of the valve the gas tightness can be further improved.

By mounting the ring of the above construction on the ignition plug 1 and screwedly fitting this plug into the cylinder head 5, hermetical seal can be obtained between the ignition plug 1 and cylinder head 5 with the deformation of the copper packings 6 fitted on the upper and lower sides of the ring body 3. The inside of the thread of the ignition plug 1 and thread of the cylinder head, valve chamber 9 and secondary air guide hole 8.

In the power stroke the valve is closed by the ball valve body 10 brought into contact with the valve seat 9*a* with the pressure built up within the cylinder, and in this way it is opened and closed in accordance with the engine cycle for introducing secondary air into the cylinder.

The operation of a gasoline engine which employs the secondary air guide ring of this construction will now be described. In the blow-down and intake strodes, the neighborhood of the ignition plug within the cylinder is under a negative pressure state slightly lower than the atmospheric pressure due to intake inertia and other causes, so that the ball valve body 9 is opened to introduce external air into the cylinder. As a result, the residual gas within the cylinder is forced out from the exhaust port, while the introduced secondary air can be sufficiently utilized as combustion supporting air in the following compression and power strokes. Thus, the volume efficiency, charging efficiency and effective pressure can be practically improved, and also overheating of the ignition plug 1 can be prevented.

As an example, the gasoline consumption in case with the secondary air guide ring mounted and that in case without ring mounted were compared by the inventor by using rings with the secondary air guide hole diameter of 0.5 to 1 mm, the ball valve body diameter of 1.0 to 1.2 mm, the inner diameter of 15 mm and the outer diameter of 19 mm, these rings being mounted together with associated ignition plugs on the 2,000 cc automotive engine. While the gasoline consumption was 5.0 km/l in case without ring, it was reduced considerably widely to 7.5 km/l in case with the ring mounted. Although there was slight fluctuation in this value at the time of high speed or load engine operating conditions, it was confirmed that fuel in excess of about 30% can be saved. In addition, it was confirmed that no noise from the valve mechanism was recognized at the time of operation at all, hence no noise problems were presented.

Figure 4:
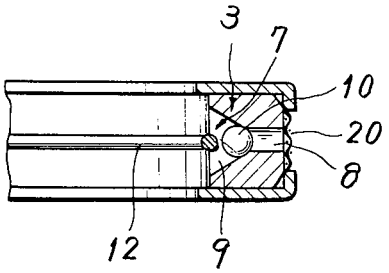
FIG. 4 is a view similar to FIG. 3 but showing a different embodiment of the invention.

FIG. 4 shows another embodiment of the invention. Here, the outer periphery of the ring body 3 is formed at its edges with notches, and also it is covered with a metal net 20 of 50 to 100 mesh size. This metal net 20 is supported by caulking copper packongs 6, and it serves to filter away dust and prevent intrusion thereof at the time of introducing the secondary air.

While in the above embodiments the secondary air is adapted to be introduced through the gap between the thread of the ignition plug and that of the cylinder head, the same effects can also be obtained by providing the outer periphery of the mounting thread of the ignition plug with a groove communication with the valve chamber. In this case, there is no influence upon the performance of the ignition plug, and also the air guide passage is free from clogging and can be reliably maintained. Further, the invention can be applied not only to the gasoline engine but also the diesel engine as well, and the above embodiments can also be used in the latter case.

As has been described in the foregoing, since according to the invention a check valve mechanism is provided on a ring providing a seal between the ignition plug and cylinder head and has a construction obtained by forming an air guide hole in the peripherel wall of the ring body, forming a valve chamber communicating with the air guide hole in the inner wall of the ring body, further forming the inner wall with a peripheral groove crossing with the valve chamber, inserting a ball valve body into the valve chamber and fitting a retainer ring having a spring character in the peripheral groove, the assembly is simple, and also the valve mechanism itself can be extremely reduced in size. Further, the mechanical strength is widely improved and the service life is far superior compared with the prior-art construction with a check valve provided in the center electrode. Furthermore, since the instant ring can be mounted without substantially changing the main portion of the ignition plug but merely in place of the packing that is initially provided, the afore-mentioned secondary air introduction method can be put into practice with a very inexpensive construction.

Moreover, as is evident from the results of tests mentioned above, according to the invention the valve can be opened and closed by following the engine cycle with high fidelity to effectively introduce external air into the cylinder, so that it is possible to widely save fuel. Besides, no mechanical noise is produced. Thus, the invention is very useful in actual practice.

I claim:

1. A secondary air guide ring for an ignition plug, said secondary air guide ring being mounted on the outer periphery of a male thread portion of the ignition plug for mounting the same in the cylinder head, said secondary air guide ring providing a hermetical seal between the ignition plug and cylinder head and being provided with a check valve mechanism communicating the inside and outside of the cylinder and functioning to prevent counter flow of gas within the cylinder, said check valve mechanism comprising an air guide hole formed in the peripheral wall of the ring body and serving to introduce air into the inside of the ring, a valve chamber communicating with the cylinder chamber through a thread gap between the ignition plug and the cylinder head, said valve chamber communicating with said air guide hole and flaring toward the inner side of the ring body made of a soft metal, a peripheral groove formed in the inner periphery of the ring body and crossing with the opening of said valve chamber, a ball valve body made of a hard metal fitted in said valve chamber for reciprocation therein to open and close said air guide hole, said ball valve body being in a position to be capable of freely moving in the valve chamber and normally in the position to open the air guide hole, and a retainer ring being like a wire fitted in said peripheral groove to prevent detachment of said ball valve body from said valve chamber.

2. A secondary air guide ring for an ignition plug as recited in claim 1, wherein the ring body has outer periphery covered with a filter being a wire net for preventing intrusion of dust.

3. A secondary air guide ring for an ignition plug according to claim 1, wherein said air guide hole has a diameter ranging from 0.5 to 1 mm, said ball valve body has a diameter ranging from 1.0 to 1.2 mm, and said ring body has an inner diameter of about 15 mm and an outer diameter of about 19 mm.

* * * * *